US010113547B2

(12) United States Patent
Andreis

(10) Patent No.: US 10,113,547 B2
(45) Date of Patent: Oct. 30, 2018

(54) PUMP PROVIDED WITH A SYSTEM FOR COMPENSATING THE INTERNAL PRESSURE

(71) Applicant: FLUID-O-TECH S.r.l., Corsico (MI) (IT)

(72) Inventor: Diego Andreis, Corsico (IT)

(73) Assignee: FLUID-O-TECH S.R.L., Corsico (MI) (IT)

( * ) Notice: Subject to any disclaimer, the term of this patent is extended or adjusted under 35 U.S.C. 154(b) by 13 days.

(21) Appl. No.: 15/267,333

(22) Filed: Sep. 16, 2016

(65) Prior Publication Data

US 2017/0082105 A1 Mar. 23, 2017

(30) Foreign Application Priority Data

Sep. 18, 2015 (IT) ..... 102015000053075

(51) Int. Cl.

| | |
|---|---|
| ***F03C 2/00*** | (2006.01) |
| ***F03C 4/00*** | (2006.01) |
| ***F04C 2/00*** | (2006.01) |
| ***F04C 18/00*** | (2006.01) |
| ***F04C 15/00*** | (2006.01) |

(Continued)

(52) U.S. Cl.

CPC ..... *F04C 15/0042* (2013.01); *F04C 2/086* (2013.01); *F04C 2/10* (2013.01); *F04C 2/18* (2013.01); *F04C 14/20* (2013.01); *F04C 15/0049* (2013.01); *F04C 15/0069* (2013.01); *F04C 23/008* (2013.01); *F04C 2240/30* (2013.01); *F05C 2201/0448* (2013.01); *F05C 2251/02* (2013.01); *F05C 2251/08* (2013.01)

(58) Field of Classification Search

CPC ..... F04C 15/0042; F04C 15/0049; F04C 15/0069; F04C 2/086; F04C 2/10; F04C 2/18; F04C 14/20; F04C 23/008; F04C 2240/30; F05C 2251/02; F05C 2201/0448; F05C 2251/08

USPC ..... 418/131–132, 206.1–206.9; 417/540

See application file for complete search history.

(56) References Cited

U.S. PATENT DOCUMENTS 3,348,492 A * 10/1967 Olson ..... F04C 2/18 418/131

3,491,697 A 1/1970 Petersen (Continued)

FOREIGN PATENT DOCUMENTS

EP 2000709 A1 12/2008

EP 2273121 A2 1/2011

(Continued)

*Primary Examiner* — Theresa Trieu

(74) *Attorney, Agent, or Firm* — King & Schickli, PLLC

(57) ABSTRACT

A pump (10) comprising a casing (12) that encloses a pumping group (14). On the casing (12) at least one inlet conduit (F) and at least one outlet conduit are obtained. The pumping group (14) comprises a pair of mutually coupled gears defining a pump chamber. A first support shaft (16) is operatively connected to an actuator assembly (18) so that the first gear can operate as a driving gear to set the second gear in rotation. The pump (10) comprises at least one element (20) for compensating the increase in volume of the fluid (F) and/or the increase in the pressures inside such a pump (10). The element (20) for compensating the pressure/volume is at least partially manufactured from a shape memory metal alloy having superelastic properties.

12 Claims, 3 Drawing Sheets

(51) Int. Cl.

| | |
|---|---|
| ***F04C 2/18*** | (2006.01) |
| ***F04C 14/20*** | (2006.01) |
| ***F04C 23/00*** | (2006.01) |
| ***F04C 2/08*** | (2006.01) |
| ***F04C 2/10*** | (2006.01) |

(56) References Cited

U.S. PATENT DOCUMENTS

| | | | | |
|---|---|---|---|---|
| 4,111,614 | A * | 9/1978 | Martin | F04C 15/0069<br>418/206.1 |
| 8,323,008 | B2 * | 12/2012 | Grimes | F04B 11/0033<br>417/540 |
| 8,734,139 | B2 * | 5/2014 | Burns | F04B 11/0033<br>417/540 |

FOREIGN PATENT DOCUMENTS

| | | | | |
|---|---|---|---|---|
| GB | 1172579 | A * | 12/1969 | F04C 15/0026 |
| WO | 2009029858 | A1 | 3/2009 | |

* cited by examiner

Fig.3
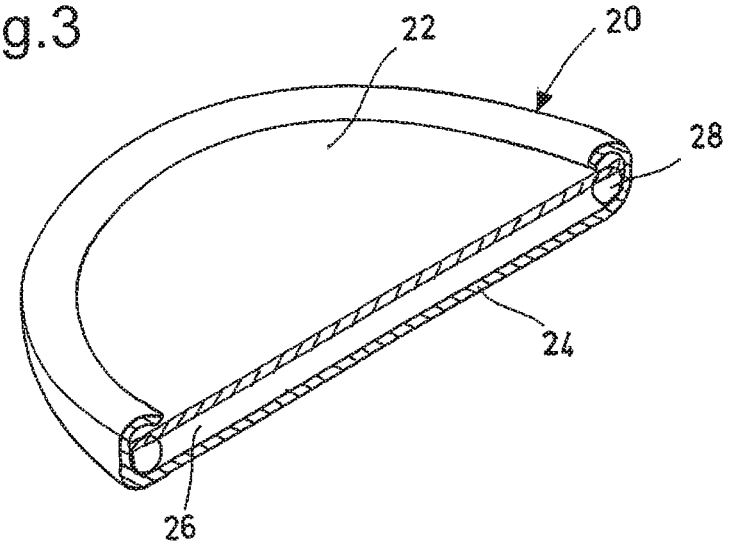
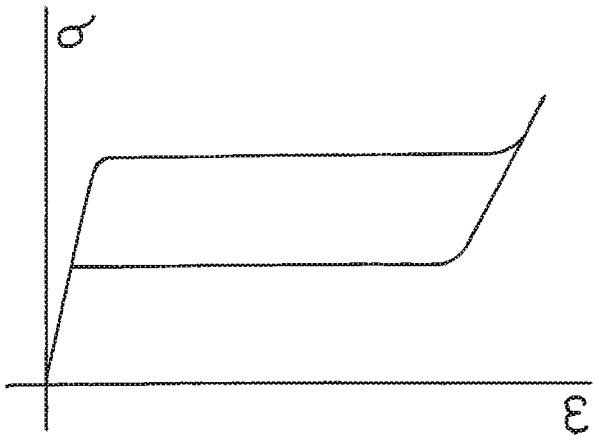
Fig.4

PUMP PROVIDED WITH A SYSTEM FOR COMPENSATING THE INTERNAL PRESSURE

This application claims priority from Italian Patent Application No. 102015000053075, filed Sep. 18, 2015, the disclosure of which is incorporated herein by reference.

FIELD OF THE INVENTION

The present invention refers in general to an operating machine for non-compressible fluids and, more specifically, to a gear pump provided with a system for compensating the internal pressure.

BACKGROUND OF THE INVENTION

The evolution of the market of fluid-managing systems in recent years has led to make increasingly efficient pumps, with the purpose of pressurising liquids and other fluids in general with the maximum possible efficiency, minimising the hydraulic losses and miniaturising the devices to the greatest possible extent. A classic response to these needs corresponds to the type of pump defined as gear pump, which has become increasingly popular in the market thanks to its characteristics of compactness, quietness, reliability and cleanliness, especially in the management of the fluid medium. Indeed, a gear pump allows keeping the fluid confined and isolated in a specific part of the pump body, close to the gears, with a guarantee of cleanliness of the fluid itself.

The advantage of being able to keep the fluid to be managed isolated has been further developed thanks to the advent of gear systems mechanically coupled to the motorised device that generates the rotary motion of such gears. This has caused the elimination of the direct contact of the fluid even with possible gaskets arranged on the drive shaft for driving the driving gear, which over time and for the most demanding applications can deteriorate and cause undesired losses of the fluid.

Gear pumps have been adopted in different technological fields, including applications that require extreme accuracy and reliability of distribution of the fluid. Consequently, gear pumps are widely used in medical apparatuses and in scientific instruments, as well as in professional equipment for ink printing.

Gear pumps are also used in the automotive industry. Gear pumps for automotive applications are characterised by different technical constraints, among which size, reliability, ease of assembly and efficiency. In particular, reliability concerns specific requirements of "long life", resistance to vibrations and maintenance of performance in the absence of losses of the pumped fluid. In addition, there are the difficult environmental conditions in which these pumps operate. Consequently, these pumps must also possess characteristics of resistance to corrosion, as well as the ability to operate in a wide range of temperatures.

For the automotive applications one of the operative conditions in which the pumps must operate includes temperatures below the freezing point of the pumped fluid, typically consisting of water or other water-based liquids. As known, water and many water-based solutions tend to increase in volume in the liquid-solid change of state by freezing.

In a defined and closed volume, in which the expansion by freezing takes place, the static pressure can reach very high values. This pressure can cause substantial damage also to a pump that is directly coupled to a hydraulic circuit exposed to the freezing temperatures of the fluid.

In many cases, the simplest solution that can be proposed is to add a suitable anti-freeze liquid to the fluid to be pressurised, so as to move the freezing point towards lower temperatures. However, this solution is not always applicable, because by changing the composition of the fluid, other important chemical properties of the fluid itself are altered, with the risk of making it ineffective for the purpose of the application.

Therefore, there is the need for the pump to be designed with specific solutions that make it intrinsically immune to the increase in static pressure of the fluid due to freezing. For this purpose, some constructive provisions have been adopted in gear pumps.

For example, document WO 2009/029858 A1 illustrates a magnetically-driven gear pump in which, inside the pumping body, a predefined space is obtained where to house a particular element placed in direct contact with the fluid. This element is configured to absorb the increase in pressure of the fluid thanks to its own negative volumetric deformation. This element is typically manufactured with a compact elastomeric material having very low hardness, or with a closed-cell foamed material, for example silicone-based.

The purpose of the present invention is therefore to make an operating machine for non-compressible fluids and, more specifically, a gear pump provided with a system for compensating the internal pressures that is capable of solving the aforementioned drawbacks of the prior art in an extremely simple, cost-effective and particularly functional manner.

SUMMARY OF THE INVENTION

In detail, a purpose of the present invention is to make a gear pump provided with a system for compensating the internal pressure that is particularly small in size.

Another purpose of the present invention is to make a gear pump provided with a system for compensating the internal pressure that has high compensation characteristics.

A further purpose of the present invention is to make a gear pump provided with a system for compensating the internal pressure that is reliable and simple to make.

Further characteristics of the invention are highlighted by the dependent claims, which are an integral part of the present description.

In general, the gear pump according to the present invention is provided with a system for compensating the internal pressure consisting of an element made of superelastic material that has the ability to withstand great deformations in the elastic field, at the same time ensuring the mechanical and chemical reliability of a conventional metal alloy.

Metal alloys with superelastic properties belong to the large family of Shape Memory Alloys (SMA). As known, a shape memory alloy is a metal alloy that keeps the "memory" of its cold shape, returning to it when it is overheated. In other words, the shape memory effect that characterises these metal alloys comes from the martensitic transformation.

When they are at low temperatures, shape memory alloys take up a martensitic configuration and possess low energy and can easily be deformed. When they are brought to higher temperatures, on the other hand, shape memory alloys take up another crystalline structure, of the austenitic type, going back to their original shape again.

Martensitic transformation, therefore, indicates the process through which the shape memory alloy passes from an austenitic configuration to a martensitic configuration through a cooling process. The temperature below which martensitic transformation begins to occur is indicated with $M_s$ ("martensite start") and can be modified through appropriate heat treatments.

In some shape memory alloys it is possible to note a particular behaviour such that, at certain temperatures, a body plastically deformed due to the application of a load recovers its original shape by simply removing the load and keeping the temperature unchanged. This phenomenon is known as pseudoelasticity and can be specified more clearly through another two phenomena: superelasticity and the rubber-like behaviour.

Superelasticity is obtained when martensite is induced by stress at a temperature greater than $A_f$ ("austenite finish" or the temperature at which the step of transformation from martensite to austenite ends). In this way, a stress is applied that, at a certain point, reaches a critical value so that the transformation becomes easy to obtain with a minimal stress. In other words, a body in martensitic phase is obtained at a temperature in which the austenitic phase should exist and therefore, as soon as the load is removed, the body undergoes the reverse transformation, going back to the austenitic phase. Basically, there is a recovery of the shape only through the removal of the load, irrespective of the temperature, as if the body were totally elastic.

The graph of FIG. 4 shows the deformation $\varepsilon$, as a function of the stress $\sigma$, of a shape memory alloy having superelastic properties. When a certain critical stress value $\sigma_c$ is reached the body deforms without addition of loads and, if the body has the load removed, reverse transformation takes place.

Consequently, the use in the pump of a system for compensating the internal pressure consisting of an element made of superelastic material has the advantage of being able to compensate for big static pressure variations when it exceeds critical values due to the expansion in volume through the effect of freezing. Vice-versa, the element made of superelastic material behaves like a normal metal, with the reliability deriving therefrom, when in the normal dynamic pressure operating conditions.

BRIEF DESCRIPTION OF THE DRAWING FIGURES

The characteristics and advantages of a gear pump provided with a system for compensating the internal pressure according to the present invention will become clearer from the following description, given as an example and not for limiting purposes, referring to the attached schematic drawings, in which:

FIG. 3 shows a detailed view of a component of the pump of FIG. 2; and

FIG. 4 is a stress-strain diagram typical of classes of materials, in particular shape memory alloys, having superelastic properties.

DETAILED DESCRIPTION OF THE INVENTION

Figure 1:
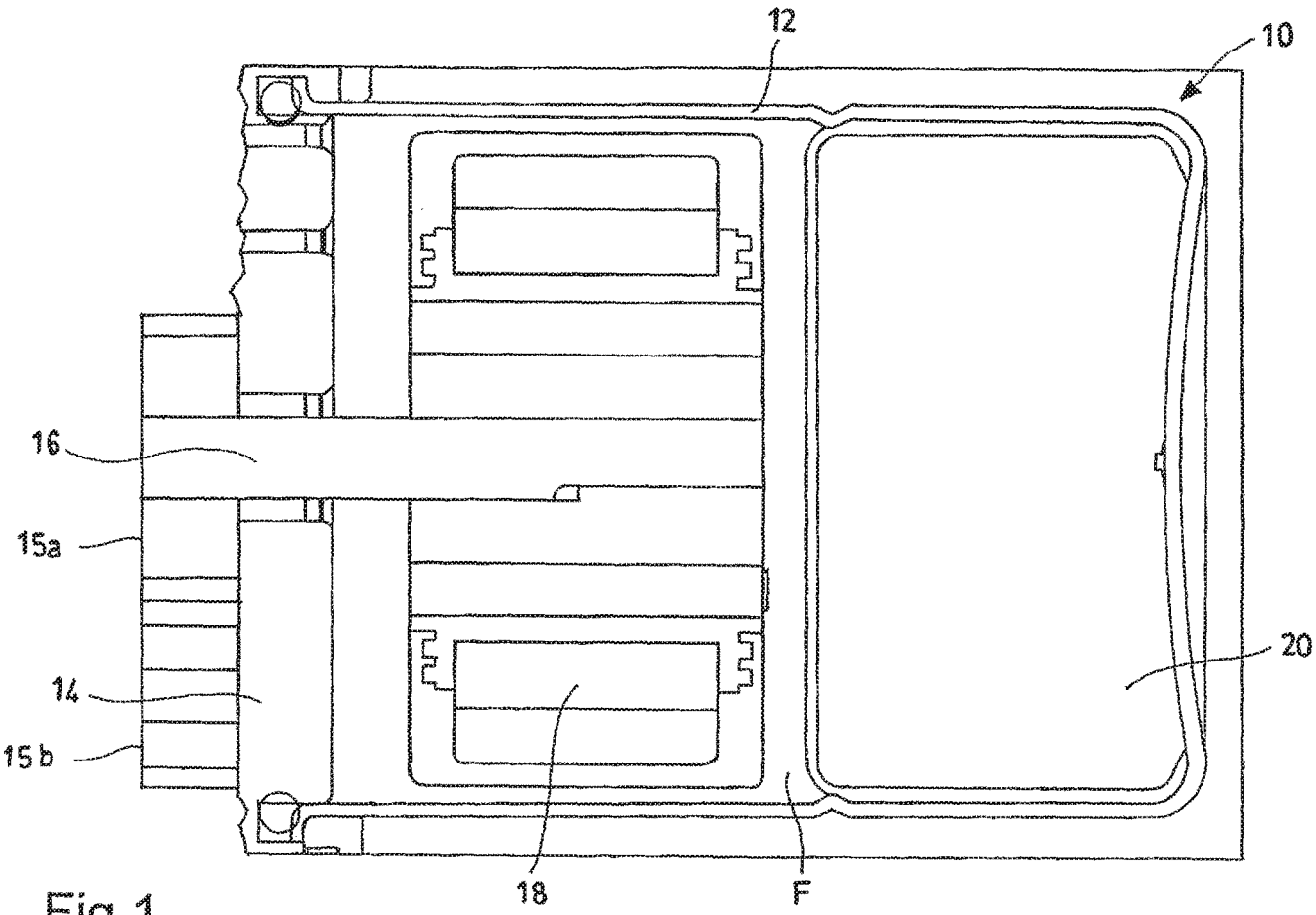
Fig.1 (PRIOR ART)
FIG. 1 is a schematic section view of a gear pump made according to the prior art.

It should be noted that, in the different attached figures, the same reference numerals indicate elements that are the same or equivalent to one another. It should also be noted that, in the following description, numerous components of the gear pump will not be mentioned, since they are well known components to the skilled in the art.

With reference in particular to FIG. 1, a gear pump made according to the prior art is shown, wholly indicated with reference numeral 10. The pump 10 comprises a casing 12 that encloses a pumping group 14 and on which at least one inlet conduit (not shown) for inletting a fluid F and at least one outlet conduit (not shown) for outletting such a fluid F are obtained.

The pumping group 14 comprises a pair of perfectly mutually coupled toothed-wheels or gears 15*a*, 15*b*, each mounted on a respective support shaft. The relative movement of the first gear 15*a* with respect to the second gear 15*b* defines a pumping chamber having variable volume inside the pumping group 14, so as to suck the fluid F from the suction conduit to expel it through the delivery conduit. In other words, the pressurisation of the fluid F takes place inside the pumping group 14.

The support shafts are oriented along respective axes that are parallel to one another. One of the support shafts, for example the shaft 16, is operatively connected to an actuator assembly 18, for example of the magnetic type, so that the respective gear 15*a* can operate as a driving gear to set the other gear 15*b* in rotation, which thus acts as driven gear. The actuator assembly 18 is preferably housed inside the casing 12.

Since the pump 10 is specifically designed for applications in which the fluid F is subject to the phenomenon of expansion of volume due to freezing, at least one deformable element 20 is also housed inside the casing 12 and arranged in direct contact with the fluid F. This deformable element 20 operates as an element for compensating the increase in volume of the fluid F and/or the increase in pressure inside the pump 10 due to the freezing of the fluid F itself.

The deformable element 20 can be manufactured with a compact elastomer or with a closed-cells foamed one, as disclosed in document WO 2009/029858 A1. However, it should immediately be noted that, in order to obtain acceptable performance, it is necessary for the deformable element 20 to have considerable thickness and volume, using a substantial amount of elastomeric material, all at the expense of the compactness of the pump 10 and of the pumping system in which it is inserted.

Figure 2:
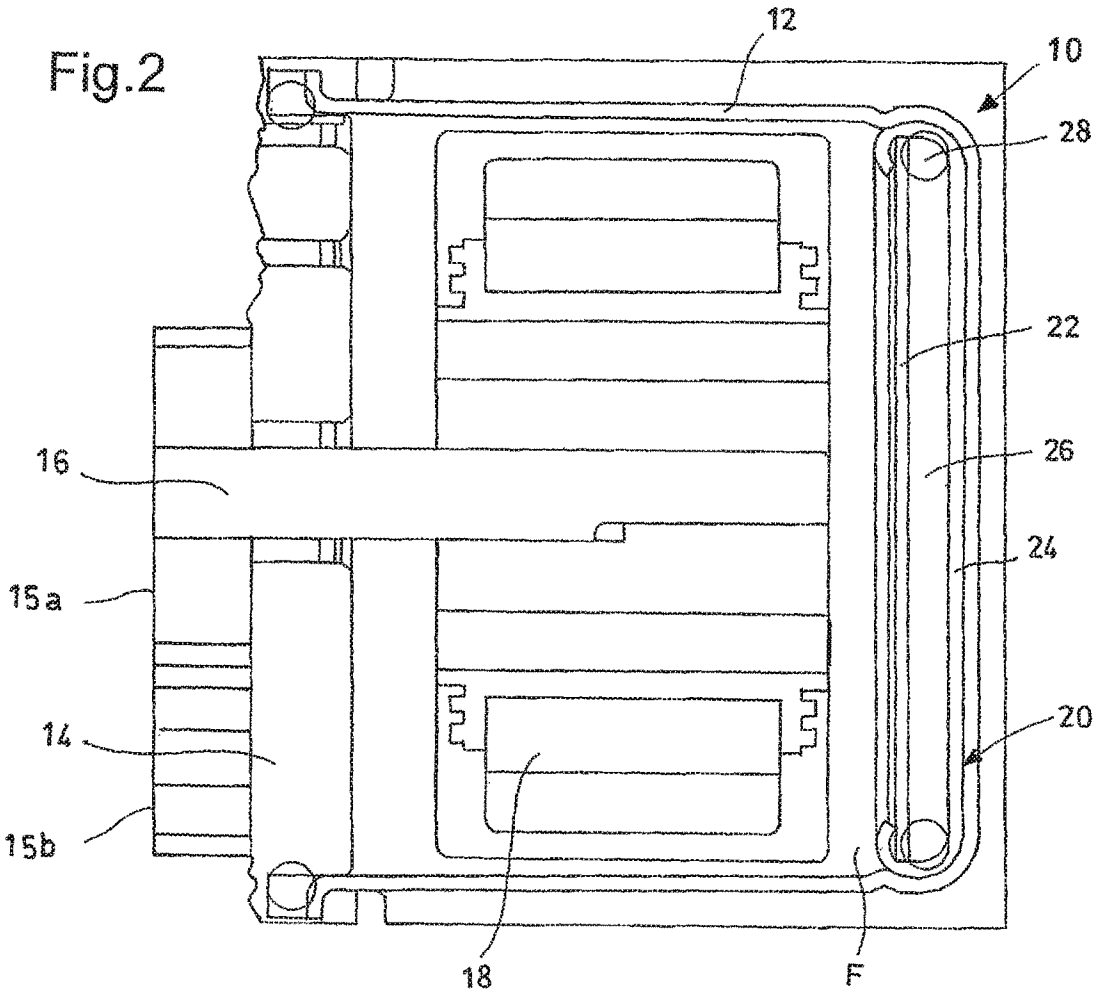
FIG. 2 is a schematic section view of a gear pump made according to the present invention.

Now with reference to FIGS. 2 and 3, a gear pump made according to the present invention is shown, still wholly indicated with reference numeral 10. The pump 10 comprises most of the technical components of known magnetically-driven gear pumps described so far.

According to the present invention, the pump 10 is provided with at least one element 20 for compensating the pressure/volume at least partially manufactured with a shape memory metal alloy having superelastic properties. In detail, as shown in FIG. 3, the element 20 for compensating the pressure/volume comprises a first wall 22, manufactured with a shape memory metal alloy having superelastic properties and configured to be placed in direct contact with the fluid F flowing inside the casing 12.

The element 20 for compensating the pressure/volume also comprises a second wall 24 manufactured with a non-deformable material, typically metallic, like for example steel. Between the first deformable wall 22 and the second non-deformable wall 24 a chamber 26 is obtained that is configured to form a hollow cavity, inside which the superelastic material that constitutes the first wall 22 can deform in critical load conditions. As shown in FIG. 3, the second non-deformable wall 24 is configured to be placed in direct contact with a wall inside the casing 12.

Preferably, both the first deformable wall 22, and the second non-deformable wall 24 are made in the form of discs mutually coupled through calking. At least one sealing ring 28 of the O-ring type is interposed between the two discs.

It has thus been seen that the gear pump provided with a system for compensating the internal pressure according to the present invention achieves the purposes outlined earlier, being advantageous particularly in terms of size with respect to known deformable elements. The element 20 for compensating the pressure/volume according to the present invention does not indeed impact upon the normal operation of the pump 10 and, thanks to the ability of the superelastic disc 22 to carry out large deformations whilst being manufactured with a metal alloy, the system is particularly strong and reliable.

Moreover, the system for compensating the internal pressure according to the present invention is simple to make, because it is made up of three elements: a disc 22 made of superelastic alloy, a sealing O-ring 28 and a drawn and calked counter-disc 24, manufactured in simple steel. In this way a small hollow cavity 26 is formed, ensured by the static O-ring seal, inside which the superelastic disc 22 can deform, compensating for the increase in volume due to the expansion of the fluid by freezing. Therefore, the uncontrolled rise in pressure is avoided through a reliable and compact system, which still remains rigid in the operating steps at nominal pressure of the pump 10.

The gear pump provided with a system for compensating the internal pressure of the present invention thus conceived can in any case undergo numerous modifications and variants, all of which are covered by the same inventive concept; moreover, all of the details can be replaced by technically equivalent elements. In practice, the materials used, as well as the shapes and sizes, can be whatever according to the technical needs.

The scope of protection of the invention is therefore defined by the attached claims.

The invention claimed is:

1. A pump comprising a casing enclosing a pumping group, at least one inlet conduit for inletting a fluid and at least one outlet conduit for outletting said fluid being obtained on said casing, said pumping group comprising a pair of mutually coupled gears, each mounted on a respective support shaft, wherein the relative movement of a first gear with respect to a second gear defines a pumping chamber having variable volume inside the pumping group, so as to suck the fluid from the inlet conduit and to eject it through the outlet conduit, a first support shaft being operatively connected to an actuator assembly so that the first gear operates as driving gear to set the second gear in rotation, the pump comprising at least one deformable element for compensating at least one of an increase in volume of the fluid and an increase in the pressures inside said pump, the pump being characterized in that said deformable element for compensating the pressure/volume is at least partially manufactured from a shape memory metal alloy having superelastic properties.

2. The pump according to claim 1, characterized in that said at least one deformable element for compensating the pressure/volume comprises a first deformable wall, manufactured from a shape memory metal alloy having superelastic properties and configured to be placed in direct contact with the fluid circulating inside the casing.

3. The pump according to claim 2, characterized in that said at least one element for compensating the pressure/volume further comprises a second wall manufactured from a non-deformable material, a chamber being obtained between the first deformable wall and the second non-deformable wall arranged to form a hollow cavity, inside which the superelastic material forming the first wall can deform under critical load conditions.

4. The pump according to claim 3, characterized in that the second non-deformable wall is configured to be placed in direct contact with an inner wall of the casing.

5. The pump according to claim 3, characterized in that said non-deformable material is a metal material.

6. The pump according to claim 5, characterized in that said metal material is steel.

7. The pump according to claim 3, characterized in that both the first deformable wall and the second non-deformable wall are made in the shape of discs mutually coupled by calking.

8. The pump according to claim 7, characterized in that at least one sealing ring of the O-ring type is interposed between said two discs.

9. The pump according to claim 1, characterized in that said actuator assembly is housed inside the casing.

10. The pump according to claim 1, characterized in that said actuator assembly is of the magnetic type.

11. A pump comprising a casing enclosing a pumping group, at least one inlet conduit for inletting a fluid and at least one outlet conduit for outletting said fluid being obtained on said casing, said pumping group comprising a pair of mutually coupled gears, each mounted on a respective support shaft, wherein the relative movement of a first gear with respect to a second gear defines a pumping chamber having variable volume inside the pumping group, so as to suck the fluid from the inlet conduit and to eject it through the outlet conduit, a first support shaft being operatively connected to an actuator assembly so that the first gear operates as driving gear to set the second gear in rotation, the pump comprising at least one insert for compensating at least one of an increase in volume of the fluid and an increase in the pressures inside said pump, the pump being characterized in that said insert for compensating the pressure/volume is at least partially manufactured from a shape memory metal alloy having superelastic properties.

12. A pump comprising a casing enclosing a pumping group, at least one inlet conduit for inletting a fluid and at least one outlet conduit for outletting said fluid being obtained on said casing, said pumping group comprising a pair of mutually coupled gears, each mounted on a respective support shaft, wherein the relative movement of a first gear with respect to a second gear defines a pumping chamber having variable volume inside the pumping group, so as to suck the fluid from the inlet conduit and to eject it through the outlet conduit, a first support shaft being operatively connected to an actuator assembly so that the first gear operates as driving gear to set the second gear in rotation, the pump comprising at least one disc-shaped insert for compensating at least one of an increase in volume of the fluid and an increase in the pressures inside said pump, the pump being characterized in that said disc-shaped insert for compensating the pressure/volume is at least partially manufactured from a shape memory metal alloy having superelastic properties.

* * * * *